US005537749A

United States Patent [19]

Cacioppo

[11] Patent Number: 5,537,749

[45] Date of Patent: Jul. 23, 1996

[54] RAZOR

[76] Inventor: Tony Cacioppo, P.O. Box 1281, Steamboat Springs, Colo. 80488

[21] Appl. No.: 268,643

[22] Filed: Jun. 30, 1994

[51] Int. Cl.[6] ..... B26B 21/40

[52] U.S. Cl. ..... 30/41.5; 30/50; 30/123.3

[58] Field of Search ..... 30/41, 41.5, 50, 30/123.3

[56] References Cited

U.S. PATENT DOCUMENTS

| | | | |
|---|---|---|---|
| 2,010,446 | 8/1935 | Stuart | 30/41 |
| 2,705,365 | 4/1955 | Van Heest | 30/41 |
| 3,832,774 | 9/1974 | Perry | 30/32 |
| 4,177,556 | 12/1979 | Galli, Jr. | 30/41 |
| 4,205,441 | 6/1980 | Turner | 30/41.5 |
| 4,212,103 | 7/1980 | Schuman-Hoole | 30/32 |
| 4,226,019 | 10/1980 | Sugiyama | 30/41 |
| 4,228,586 | 10/1980 | Thierry | 30/41 |
| 4,535,537 | 8/1985 | Ferraro et al. | 30/32 |
| 4,640,012 | 2/1987 | Thomas | 30/41 |
| 5,335,417 | 8/1994 | Genero et al. | 30/41.5 |

FOREIGN PATENT DOCUMENTS 628331 11/1949 United Kingdom .

*Primary Examiner*—Rinaldi I. Rada
*Assistant Examiner*—Raymond D. Woods
*Attorney, Agent, or Firm*—Sixbey, Friedman, Leedom & Ferguson; Donald R. Studebaker

[57] ABSTRACT

A razor including a shaving head with at least one blade attached to the shaving head which has an exposed shaving edge extending longitudinally on the shaving head for use in shaving. A passage is provided in the shaving head which extends from one end of the shaving head to the opposite end. Water for cleaning of the blades can be applied to an inlet at one end of the passage by placing the inlet under a running water faucet. A first outlet for discharging water from the passage is provided and is located adjacent to the shaving edge of the blade to clear shaving debris from the blade. The passage also includes a second outlet at the opposite end of the shaving head from the inlet. The second outlet has dimensions less than the dimensions of the inlet so that the volume of water passing through the inlet is greater than the volume of water passing through the second outlet. The difference in size between the inlet of the passage and the second outlet causes the fluidic pressure of the rinsing water to increase as the water travels from the inlet toward the second outlet. The increasing pressure of the rinsing water causes the water to flow through the first outlet with greater force, while still allowing a portion of the rinsing water to flow out of the second outlet.

12 Claims, 3 Drawing Sheets

RAZOR

BACKGROUND OF THE INVENTION

TECHNICAL FIELD

The present invention relates to razors and more particularly to a razor having a shaving head which is specially constructed to facilitate cleaning of the razor blades.

BACKGROUND ART

Although manual razors are available in a variety of different types, they all include one or more razor blades. Recently, two edge razors have gained popularity because of their ability to achieve a close shave. In one razor construction, the blades are removable from the shaving head and can be discarded when they become less effective. Another type of razor includes a replaceable shaving head which can be detached from the handle and discarded when the blades become worn. Also available are disposable razors which are to be discarded in their entireties when the blades lose their sharpness.

All manual razors are subject to the accumulation of shaving lather and severed whiskers in the area of the blades, and this material must be removed from time to time in order to keep the razor in condition to provide a close shave and avoid undue irritation of the skin. Typically, the shaving head is either dipped in water or rinsed under a faucet to remove the accumulated lather and whiskers while at the same time wetting the blades. Although this procedure usually removes the majority of the lather and whiskers, it does not remove all of the accumulated materials and particularly the material that is firmly lodged in place in the shaving head. The small gap that is present between the two blades in a two edge razor is especially prone to becoming clogged with shaving debris, and material which remains in this gap can reduce the effectiveness of the razor and increase the skin irritation.

Various types of special razors have been proposed to facilitate cleaning of the blade area. However, none of these devices has been entirely satisfactory in all respects. Razors such as that shown in U.S. Pat. No. 4,226,019 to Sugiyama require a special mechanical ejector member for physically pushing material out of the space between the two blades, and this adds appreciably to the cost and complexity of the razor. The razor shown in U.S. Pat. No. 4,205,441 to Turner relies upon suction to maintain the blade area clear of material and also requires an overly complicated construction of the razor. U.S. Pat. Nos. 4,177,556 and 4,228,586 to Thierry disclose the concept of applying water through the razor handle to the blade area during the course of shaving. This involves the provision of a passage through the entire length of the handle and also requires long flexible tubing and special connections to connect the free end of the handle with a water faucet or other source of water.

In an effort to overcome the shortcomings of these razors, U.S. Pat. No. 4,640,012 to Thomas discloses the concept of cleaning the blades by running water through a pair of passages which extend into opposite ends of a shaving head with the water being forced out of the shaving head through slots which direct the water to the shaving edges of the razor blades and to the area between the blades to dislodge accumulated shaving material. The passages are separated by an internal partition which prevents water applied to one passage from flowing out the other passage. By providing such passage, shaving lather and severed whiskers may tend to accumulate and harden in the corners where the partition meets the shaving head. However, if such partition were not present, a majority of the water flowing into one end of the razor would merely continue through the back portion of the razor and not flow through the blade area as desired.

Clearly, there is a need for a razor, disposable or otherwise, which may be readily cleaned during usage and which when cleaned, completely removes all shaving lather and severed whiskers from between the blades as well as from within the housing accommodating such blades.

SUMMARY OF THE INVENTION

It is a primary object of the present invention to overcome the aforementioned shortcomings associated with the prior art.

Another object of the present invention is to provide a razor which can easily be cleaned by running water through the razor head.

Yet another object of the present invention is to provide a razor having a structure which facilitates the removal of razor stubble and collected lather from between the shaving blades of a shaving head as well as the shaving head itself.

It is yet another object of the present invention to provide a razor of a construction which resists the accumulation of razor stubble and shaving lather in the interior of the shaving head.

These as well as additional objects and advantages of the present invention are achieved by providing a razor having a shaving head with at least one blade attached to the shaving head which has an exposed shaving edge extending longitudinally on the shaving head for use in shaving. A passage is provided in the shaving head which extends from one end of the shaving head to the opposite end, wherein water for cleaning of the blades can be applied to an inlet at one end of the passage by placing the inlet under a running water faucet. A first outlet for discharging water from the passage is provided and is located adjacent to the shaving edge of the blade to clear shaving debris from the blade. The passage also includes a second outlet at the opposite end of the shaving head from the inlet. The second outlet has dimensions less than the dimensions of the inlet so that the volume of water passing through the inlet is greater than the volume of water passing through the second outlet. The difference in size between the inlet of the passage and the second outlet causes the fluidic pressure of the rinsing water to increase as the water travels from the inlet toward the second outlet. The increasing pressure of the rinsing water causes the water to flow through the first outlet with greater force, while still allowing a portion of the rinsing water to flow out of the second outlet.

It is also an object of the present invention to provide a razor of the type described above in which the passage in the shaving head is of a frustoconical shape.

It is still another object of the present invention to provide a razor of the type describe above in which the passage in the shaving head is formed with a structure which causes the rinsing water to swirl as it travels through the passage.

It is still a further object of the present invention to provide a razor of the type described above wherein the passage in the shaving head includes a plurality of curved flanges spaced apart from one another to divert water from the passage to the first outlet located adjacent the shaving edge of the blade.

These as well as additional advantages of the present invention will become apparent from the following detailed description of the invention with reference to the several figures.

DETAILED DESCRIPTION OF THE PREFERRED EMBODIMENT

Figure 1:
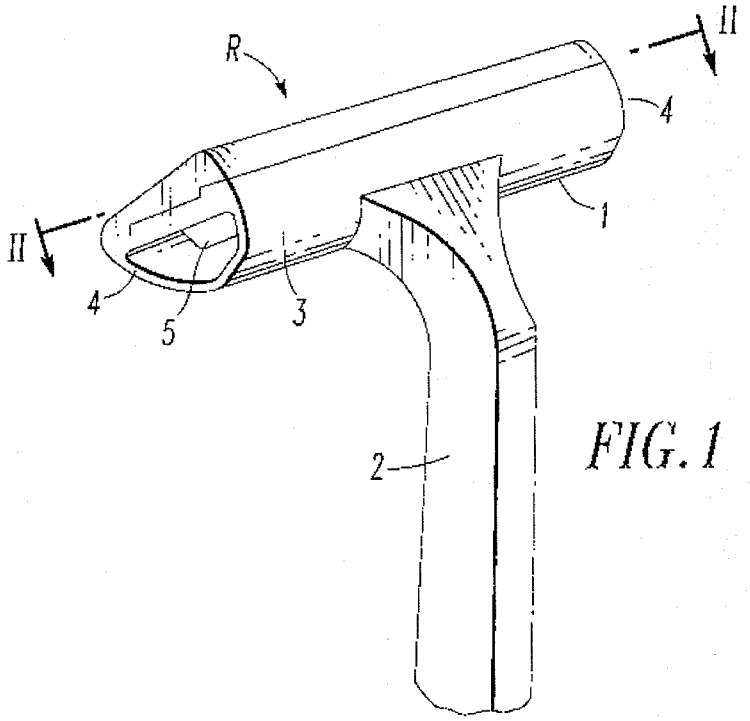
FIG. 1 is a perspective view of a razor constructed according to the preferred embodiment of the present invention.

Referring now to FIG. 1, the razor R is illustrated and includes a shaving head 1 and a handle 2 for holding the razor R. The shaving head 1 includes a housing 3 having opposite ends 4*a* and 4*b* with a longitudinal dimension extending between the ends 4*a* and 4*b*. The shaving head 1 is attached to one end of the handle 2 at a location on the housing 3 between the ends 4*a* and 4*b*. A passage 5 extends longitudinally for the entire length of the shaving head 1 from one end 4*a* to the opposite end 4*b*, the significance of the passage will be set forth in greater detail hereinbelow.

Figure 3:
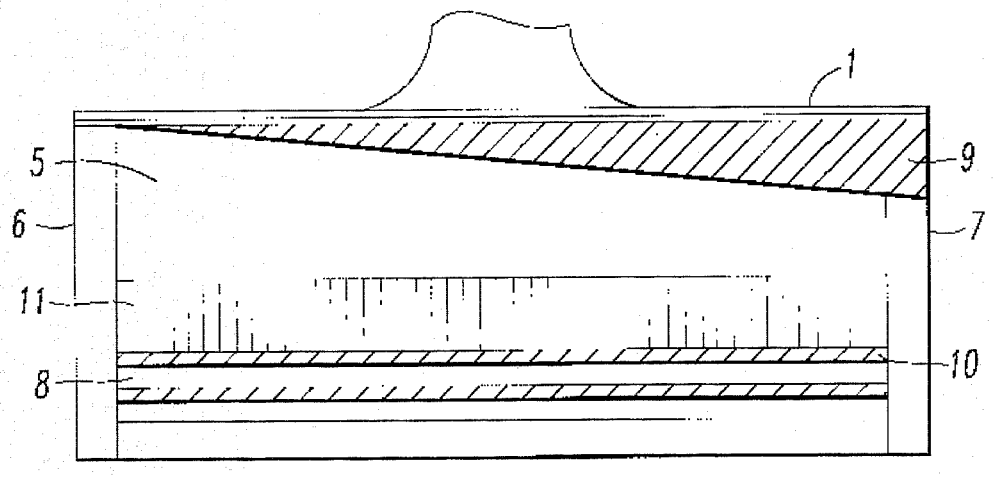
FIG. 3 is a sectional top plan view taken generally along line II—II of FIG. 1.

In accordance with the present invention, the housing 3 of the shaving head 1 is hollow in order to provide the passage 5 which is best shown in FIG. 3. The passage 5 includes an inlet 6 on one end 4*a* of the housing 3 for receiving water, wherein the inlet 6 has a predetermined dimension. An outlet 8 for discharging water from the passage 5 is located adjacent to a shaving edge 10 of a razor blade 11. The razor blade 11 has an exposed shaving edge 10 on the front side of the blade, and the shaving head 1 contains at least one razor blade attached to the housing 3. As the water passes through the outlet 8, the water passes over the blade and cleans shaving debris and lather from the blade. An additional outlet 7 is provided at the opposite end 4*b* of the inlet 6 on the housing 3 for discharging water from the passage 5. The passage 5 tapers as the passage extends from the inlet 6 toward the outlet 7, while the thickness of the rear portion 9 of the housing 3 gradually increases as the passage extends from the inlet 6 toward the outlet 7. Accordingly, the dimension of the outlet 7 is less than that of inlet 6, so the volume of water passing through the inlet 6 is greater than the volume of water passing through the outlet 7. Since the volume of water entering the inlet 6 is greater than that exiting the outlet 7, the excess water is expelled through outlet 8. The smaller dimensional size of the outlet 7 causes the fluidic pressure of the water in the passage 5 to increase as the water travels through the passage 5. The increased fluidic pressure expels the water in the passage out of the outlet 8 adjacent to the blades with a greater force than merely rinsing the blades, which increases the effectiveness of removing shaving debris and lather from between the shaving blades.

Figure 2:
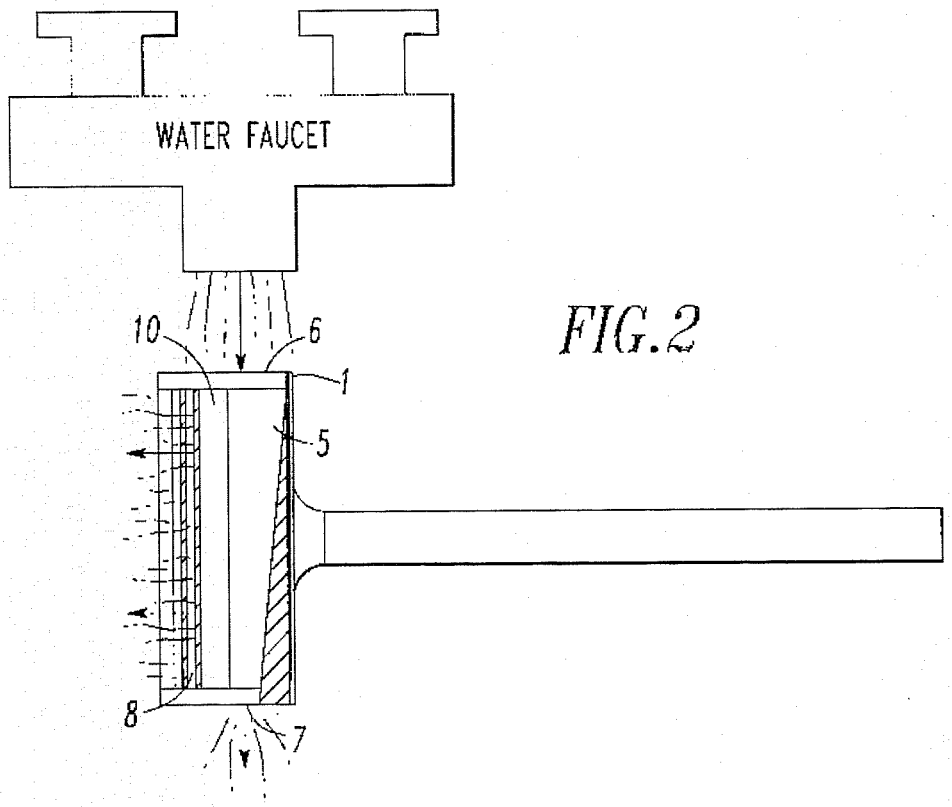
FIG. 2 is a sectional top plan view taken generally along line II—II of FIG. 1, with the directional arrows indicating the flow of water during cleaning of the razor.

The process of cleaning the razor R is best illustrated in FIG. 2 with directional arrows indicating the flow of water through the shaving head 1. The shaving head is positioned under a running water faucet so that the flow of water enters the inlet 6 of passage 5. As the water flows through the passage 5, the water will flush any accumulated shaving debris and lather inside of the passage 5 out of passages 7 and 8. Additionally, the increasing fluidic pressure of the water flowing through the passage resulting from the having the outlet 7 smaller than the inlet 6 will assist in diverting a portion of the water through outlet 8 adjacent to the blades 11. The water exiting the passage 5 through outlet 8 will pass over both sides of the blades in order to remove accumulated shaving debris and lather on the blades. Furthermore, the increasing fluidic pressure of the water due to the tapered passage 5 will cause the water to exit through outlet 8 with a force which will be more effective in dislodging accumulated shaving debris from the blades 11.

The passage 5 described hereinabove may be of any shape wherein the inlet 6 end of the passage is larger than the outlet 7 end of the passage. As the passage 5 tapers inwardly moving from the inlet 6 towards the outlet 7, the thickness of the rear portion 9 of the housing 3 will gradually increase as the passage extends from the inlet 6 toward the outlet 7. By gradually increasing the thickness of the rear portion 9 of the housing 3, the passage 5 will remain smooth and resist the accumulation of the shaving debris and lather. In one embodiment, the passage may be of a frustoconical shape extending longitudinally in decreasing diameter from the inlet 6 to the outlet 7 of the shaving head 1.

Figure 4:
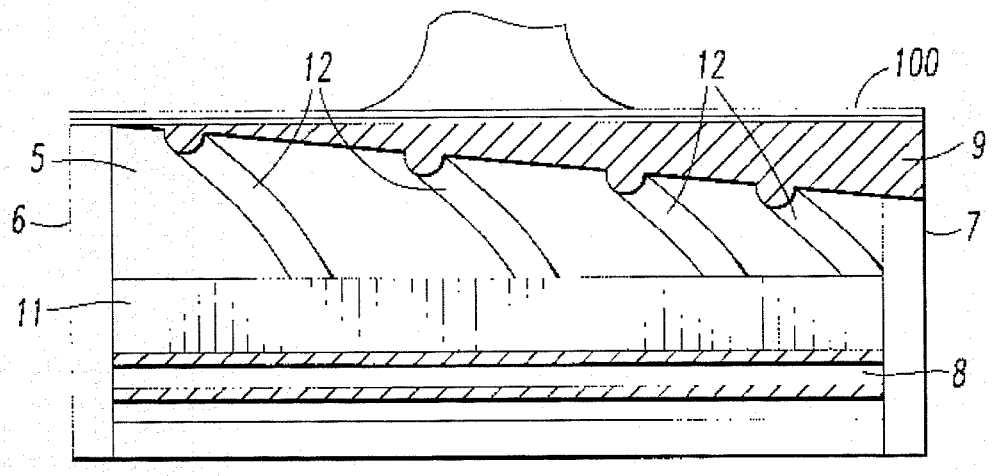
FIG. 4 is a sectional top plan view taken generally along line II—II of FIG. 1 in accordance with an alternative embodiment of the present invention.

Referring now to FIG. 4, the shaving head 100 is illustrated and is essentially identical to that of shaving head 1 set forth in FIG. 3 with the exception of a series of raised portions 12 formed in the passage 5. The raised portions 12 extend in a spiral fashion around the passage 5 and serve to agitate the water as it flows through the passage 5. As the water travels through the inlet 6 and into the passage 5, the spirally extending raised portions 12 serve to create a swirling motion in the water passing through the passage 5. The swirling motion of the water tends direct a larger portion of the water flowing through passage 5 over the blades 11 and through outlet 8. Additionally, the swirling motion of the water created by the raised portions 12 agitate the water flowing through the passage which further assists in cleaning shaving debris and lather from the passage 5 and blades 11.

Figure 6:
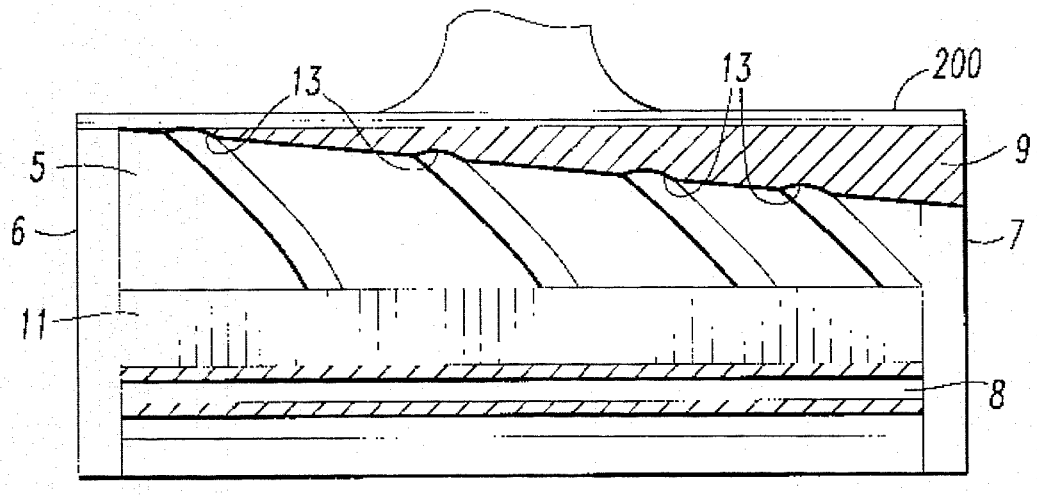
FIG. 6 is a sectional top plan view taken generally along line II—II of FIG. 1 in accordance with an alternative embodiment of the present invention.

Referring now to FIG. 6, the shaving head 200 is illustrated and is essentially identical to that of shaving head 1 set forth in FIG. 3 with the exception of a series of grooves 13 formed in the passage 5. The grooves 13 extend in a spiral fashion around the passage 5 and serve to agitate the water as it flows through the passage 5 similar to that of the raised portions 12 discussed hereinabove. As the water travels through the inlet 6 and into the passage 5, the spirally extending grooves 13 serve to create a swirling motion in the water passing through the passage 5. As with the previous embodiment, the swirling motion of the water tends direct a larger portion of the water flowing through passage 5 over the blades 11 and through outlet 8. Additionally, the swirling motion of the water created by the grooves 13 agitates the water flowing through the passage which further assists in cleaning shaving debris and lather from the passage 5 and blades 11.

Figure 5:
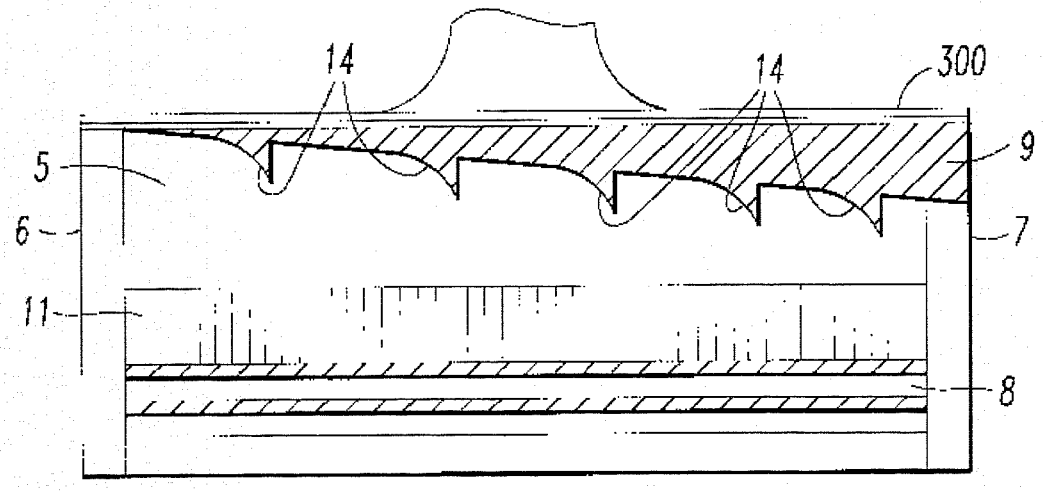
FIG. 5 is a sectional top plan view taken generally along line II—II of FIG. 1 in accordance with an alternative embodiment of the present invention.

Referring now to FIG. 5, the shaving head 300 is illustrated and is essentially identical to that of shaving head 1 set forth in FIG. 3 with the exception of a plurality of curved flanges 14 formed in the passage 5. The curved flanges 14 are spaced apart from one another and serve to divert water flowing through the passage 5 to outlet 8 located adjacent to the shaving blades 11. In this manner, a larger portion of the water flowing through passage 5 exits through outlet 8 to more effectively remove accumulated shaving debris from the blades 11.

As can be seen from the foregoing, a razor formed in accordance with the present invention will provide a shaving head which can easily be cleaned during and after use by running water through the shaving head. Moreover, by forming the shaving head in accordance with the present invention, a passage in the shaving head is provided which distributes water through an outlet adjacent to the shaving blades to effectively clean any shaving debris or lather from the blades and the inside of the shaving head itself.

While the present invention has been described with reference to the preferred embodiment, it will be appreciated by those skilled in the art that the invention may be practiced otherwise than as specifically described herein without departing from the spirit and scope of the invention. It is, therefore, to be understood that the spirit and scope of the invention be limited only by the appended claims.

What is claimed is:

1. A razor shaving head comprising:

a housing having opposite ends and a longitudinal dimension defined between said ends;

at least one razor blade attached to said housing having an exposed shaving edge extending generally longitudinal on said housing for use in shaving;

a passage in said housing extending longitudinally from one of said ends of said housing to the opposite end of said housing;

an inlet to said passage at said one end of said housing for receiving water, said inlet having a predetermined dimension;

a first outlet for said passage located adjacent said shaving edge of the blade for discharging water from the passage against said edge to clear shaving debris from the blade; and a second outlet for said passage at the opposite end of said inlet on said housing for discharging water;

said passage being frustoconical in shape extending longitudinally in decreasing diameter from said inlet of said housing to said second outlet of said housing with said second outlet having a dimension less than said predetermined dimension such that a volume of water passing through said inlet is greater than a volume of water passing through said second outlet.

2. The razor shaving head as defined in claim 1, wherein said passage includes a plurality of curved flanges spaced apart from one another to divert water from the passage to said first outlet located adjacent said shaving edge of the blade.

3. The razor shaving head as defined in claim 1, wherein said blade comprises a pair of spaced apart blades.

4. A disposable razor comprising:

a shaving head having opposite ends and a longitudinal dimension defined between said ends;

at least one razor blade attached to said shaving head having an exposed shaving edge extending generally longitudinal on said shaving head for use in shaving;

a handle extending from said shaving head;

a passage in said shaving head extending longitudinally from one of said ends of said shaving head to the opposite end of said shaving head;

an inlet to said passage at said one end of said shaving head for receiving water, said inlet having a predetermined dimension;

a first outlet for said passage located adjacent said shaving edge of the blade for discharging water from the passage against said edge to clear shaving debris from the blade; and a second outlet for said passage at the opposite end of said inlet on said shaving head for discharging water;

said passage being frustoconical in shape extending longitudinally in decreasing diameter from said inlet of said shaving head to said second outlet of said shaving head with said second outlet having a dimension less than said predetermined dimension such that a volume of water passing through said inlet is greater than a volume of water passing through said second outlet.

5. The razor as defined in claim 4, further comprising swirling means for creating a swirling motion in water passing through said passage.

6. The razor as defined in claim 5, wherein said swirling means is formed in said passage.

7. The razor as defined in claim 6, wherein said swirling means includes at least one spiral element positioned within said passage.

8. The razor as defined in claim 4, wherein said passage includes a plurality of curved flanges spaced apart from one another to divert water from the passage to said first outlet located adjacent said shaving edge of the blade.

9. The razor as defined in claim 4, wherein said blade comprises a pair of spaced apart blades.

10. A razor shaving head comprising:

a housing having opposite ends and a longitudinal dimension defined between said ends;

at least one razor blade attached to said housing having an exposed shaving edge extending generally longitudinal on said housing for use in shaving;

a passage in said housing extending longitudinally from one of said ends of said housing to the opposite end of said housing;

an inlet to said passage at said one end of said housing for receiving water, said inlet having a predetermined dimension;

a first outlet for said passage located adjacent said shaving edge of the blade for discharging water from the passage against said edge to clear shaving debris from the blade;

a second outlet for said passage at the opposite end of said inlet on said housing for discharging water, said second outlet having a dimension less than said predetermined dimension such that a volume of water passing through said inlet is greater than a volume of water passing through said second outlet; and a swirling means for creating a swirling motion in water passing through said passage.

11. The razor shaving head as defined in claim 10, wherein said swirling means is formed in said passage.

12. The razor shaving head as defined in claim 11, wherein said swirling means includes at least one spiral element positioned within said passage.

* * * * *